US006783175B1

(12) United States Patent
Henderson

(10) Patent No.: US 6,783,175 B1
(45) Date of Patent: Aug. 31, 2004

(54) DEPLOYABLE AND CONTRACTIBLE CUSHION STRUCTURE INCLUDING MEANS FOR DETACHABLE ATTACHMENT ABOUT WAIST

(76) Inventor: Jeanne M. Henderson, 3374 Walton Way, San Jose, CA (US) 95117

( * ) Notice: Subject to any disclaimer, the term of this patent is extended or adjusted under 35 U.S.C. 154(b) by 0 days.

(21) Appl. No.: 10/420,189

(22) Filed: Apr. 21, 2003

(51) Int. Cl.[7] ..... A47C 1/00

(52) U.S. Cl. ..... 297/4; 297/228; 297/284.5; 297/219.1; 5/653

(58) Field of Search ..... 297/4, 284.5, 188.08, 297/219.1, 228.1, 228.13, 230, 229, 228.12; 5/653, 654

(56) References Cited

U.S. PATENT DOCUMENTS 4,842,330 A * 6/1989 Jay ..... 297/4
4,843,662 A * 7/1989 Handelman ..... 5/653
4,882,213 A * 11/1989 Gaddis et al. ..... 428/136
4,891,454 A * 1/1990 Perdelwitz et al. ..... 428/137
4,925,064 A * 5/1990 Comora ..... 224/155
4,955,665 A * 9/1990 Richer ..... 297/4
5,271,659 A * 12/1993 Zinkevicz ..... 297/4
5,275,463 A * 1/1994 Rocha ..... 297/229
5,421,637 A * 6/1995 Lemburg ..... 297/188.01
5,520,438 A * 5/1996 Stulik ..... 297/284.11
5,524,956 A * 6/1996 Moore ..... 297/4
5,642,540 A * 7/1997 Culver et al. ..... 5/499
5,806,925 A * 9/1998 Hanley ..... 297/229
6,244,481 B1 * 6/2001 Brougher ..... 224/153
6,371,641 B1 * 4/2002 Wilson, Jr. ..... 383/4
6,588,840 B1 * 7/2003 Lombardo ..... 297/228.12

* cited by examiner

*Primary Examiner*—Peter M. Cuomo
*Assistant Examiner*—Erika Garrett
(74) *Attorney, Agent, or Firm*—John J. Leavitt; Alexander D. Raring

(57) ABSTRACT

Presented is a deployable and contractible cushion structure for detachable attachment about the waist of a user, formed from a unitary flat piece of preferably woven fabric that is folded and sewn to provide in its completed form three separate pockets. In a first or primary pocket is contained a relatively thick elastically resilient cushion pad formed from open or closed cell polyurethane or other suitable synthetic resinous material. A second pocket, substantially in the same plane as the primary pocket and opening in the direction of the open end of the primary pocket, is provided to contain the elastically resilient cushion pad when it and the primary pocket in which it is contained are rolled into a generally cylindrical roll to fit within the second pocket. A flap is provided to retain the rolled elastically resilient cushion pad in contracted form when not in use. A third pocket is formed in the flap that forms the closure for the second pocket and is provided with a zipper enabling enclosure and containment of valuables such as money, tickets or car keys that are out of sight but which are readily available by unzipping the third pocket. A flexible belt is manipulable to detachably secure the contracted cushion structure about the waist of the user.

18 Claims, 7 Drawing Sheets

DEPLOYABLE AND CONTRACTIBLE CUSHION STRUCTURE INCLUDING MEANS FOR DETACHABLE ATTACHMENT ABOUT WAIST

BACKGROUND OF THE INVENTION

1. Field of the Invention

This invention relates to waist-supported carrying devices such as packs for carrying personal possessions and more particularly relates to a waist-supported seat cushion structure including an elastically resilient cushion pad stored in extended form within its own first pocket, both the first pocket and the cushion pad being enclosed within a second pocket when not in use but which are deployable by extraction of the first pocket and contained cushion pad from the second pocket while still attached thereto and extended for use as a soft and elastic seat cushion on which a person may comfortably sit for long intervals.

2. Background of the Invention

A preliminary patentability and novelty search has revealed the existence of the following United States patents:

| | | |
|---|---|---|
| 3,062,580 | 4,588,224 | 4,925,064 |
| 4,955,665 | 5,275,315 | 6,010,183. |

A careful review of each of these patents has failed to reveal the invention disclosed and claimed herein.

Some of the most popular sources of entertainment for the public are sporting events such as basketball, football, tennis and other such sporting events that attract tens of thousands of spectators to view a contest between teams, including multiple participants, or pairs of participants, such as in the sport of tennis. In each of these instances, it is customary for the spectators to sit on some type of supporting structure, whether it is a concrete ledge, a wooden bench or folding wooden or plastic chairs. In all of these seating arrangements for spectators, the posterior of an individual sitting for several hours to view the sporting event becomes uncomfortable to the point that the discomfort motivates the spectator to stand up occasionally to relieve the discomfort associated with the spectator's posterior to the detriment of another spectator that is seated behind the person that must stand to relieve his or her discomfort and thus block the view for the person sitting immediately behind the person standing.

It is therefore one of the primary objects of the present invention to provide a composite cushion structure on which the spectator may sit during the course of the sporting event so as to provide an elastically resilient and comfortable seat for the spectator that alleviates or precludes discomfort from extended sitting.

Another object of the invention is the provision of a cushion structure that not only provides resiliently comfortable cushioned support for a spectator's posterior but that is also provided with a convenient means for carrying the cushion structure so as to eliminate the inconvenience of having to carry the cushion structure under the arms or in the hands which are in most instances occupied with other things being carried, such as food and beverages.

Still another object of the invention is the provision of an elastically resilient cushion structure including a carrying case or component for secure enclosure of the resilient cushion pad in a small compact unit that may be detachably secured about the person's waist.

Yet another object of the invention is the provision of a cushion structure that may be utilized as a comfortable elastically resilient seat while the attached carrying case for the cushion is attached about a person's waist A still further object of the invention is the provision of a deployable and contractible cushion structure that includes a pocket within which valuable items such as money, tickets, check book or other things such as car keys may be securely enclosed while the cushion is being sat upon without danger that these valuables will be stolen.

The invention possesses other objects and features of advantage, some of which, with the foregoing, will become apparent from the following description and the drawings. It is to be understood however that the invention is not limited to the embodiment illustrated and described since the invention may be embodied in other forms within the scope of the appended claims.

SUMMARY OF THE INVENTION

In terms of broad inclusion, the deployable and contractible cushion structure, including means for detachable attachment about the waist of a user, comprises initially a unitary flat piece of preferably woven fabric that is ultimately folded and sewn to provide in its completed form three separate and different pockets, each of the pockets being provided with specific closure means. In a first of the pockets is contained a relatively thick elastically resilient cushion pad formed from open or closed cell polyurethane or other suitable synthetic resinous material. A second pocket, substantially in the same plane as the pocket containing the resilient pad and opening in the direction of the open end of the first pocket, is provided to contain the elastically resilient cushion pad when it and the pocket in which is contained are contracted into a generally cylindrical roll to fit within the second pocket that is thereafter closed by a flap to retain the rolled elastically resilient cushion pad in contracted form when not in use. A third pocket is formed in the flap that forms the closure for the second pocket and is provided with a zipper enabling enclosure and containment of valuables such as money, tickets or car keys that are out of sight but which are readily available by unzipping the third pocket. Means are also provided retaining the assembly in contracted form when the resilient cushion pad, contained in its separate pocket, is rolled up and inserted into the second pocket and the flap closed to encase and retain the cushion pad in its contracted rolled form. Additionally, means are provide mounted outside of the second pocket, including a flexible belt, manipulable to detachably secure the contracted cushion structure about the waist of the user.

DESCRIPTION OF THE PREFERRED EMBODIMENT

In terms of greater detail, the deployable and contractible cushion structure of the invention comprises a structure that provides, among other things, an enclosed elastically resilient cushion pad on which, when deployed, a user may sit for long intervals on hard benches, chairs or seats without discomfort and which may be detachably secured about the waist of a user when not in use and contracted to minimize its size, may be retained detachably secured about the waist of the user when deployed for use, or may be removed or detached from the waist of the user and deployed for use without being attached to the waist of the user during use. The versatility of the structure for performance in all these different attitudes stems from its unique composite design that includes a relatively thick elastically resilient cushion pad that is detachably contained within a "pocket" designed to envelop the cushion pad when the structure is not in use and which continues to envelop the cushion pad when deployed for use so as to prevent the cushion pad from being dropped, lost or soiled during use while deployed and which contains the cushion pad in a small contracted size for convenience in carrying when not in use.

Figure 1:
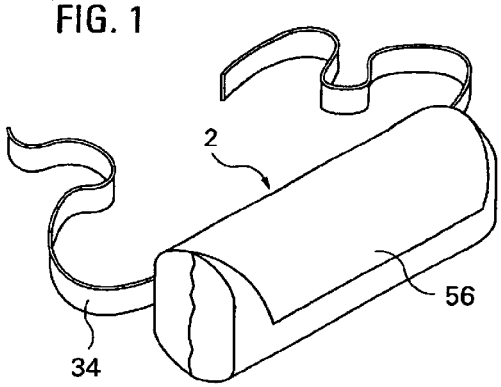
FIG. 1 is a perspective view of the cushion structure of the invention in contracted and closed form ready for attachment about the waist of the user.
Figure 2:
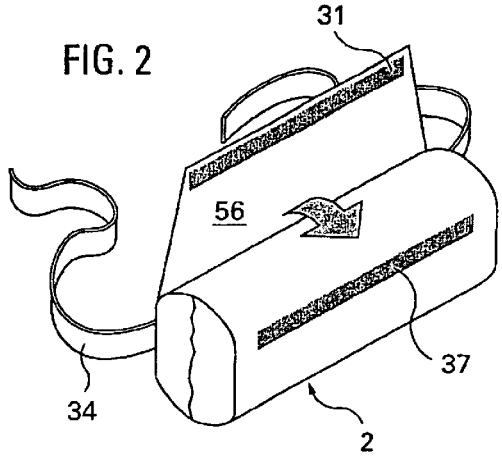
FIG. 2 is a perspective view illustrating the cushion structure with the closure flap of the second pocket open and the first pocket with enclosed cushion pad ready to be extracted from the second pocket in the direction of the arrow and deployed for use.
Figure 9:
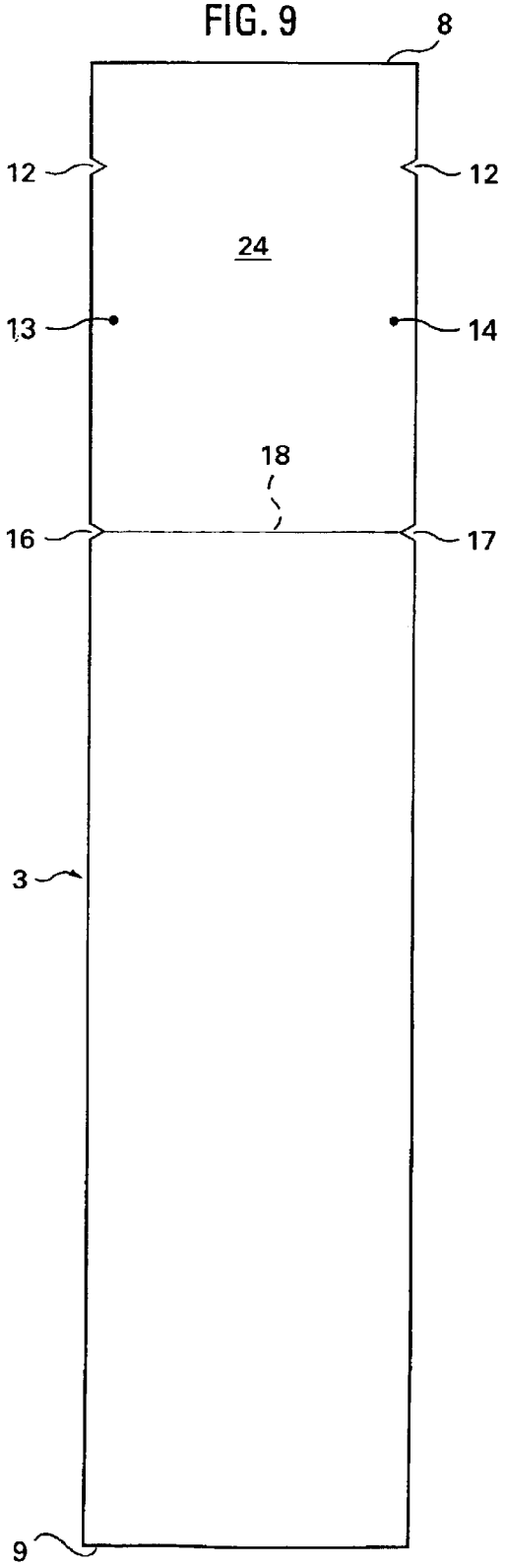
FIG. 9 is a plan view of the back or "wrong" side of the strip of fabric from which the envelope for the cushion pad is formed and sewn and showing marker notches on opposite edges spaced at predetermined intervals measured from the top edge of the strip and showing marker "dots" adjacent opposite edges of at a predetermined distance from the top edge.
Figure 13:
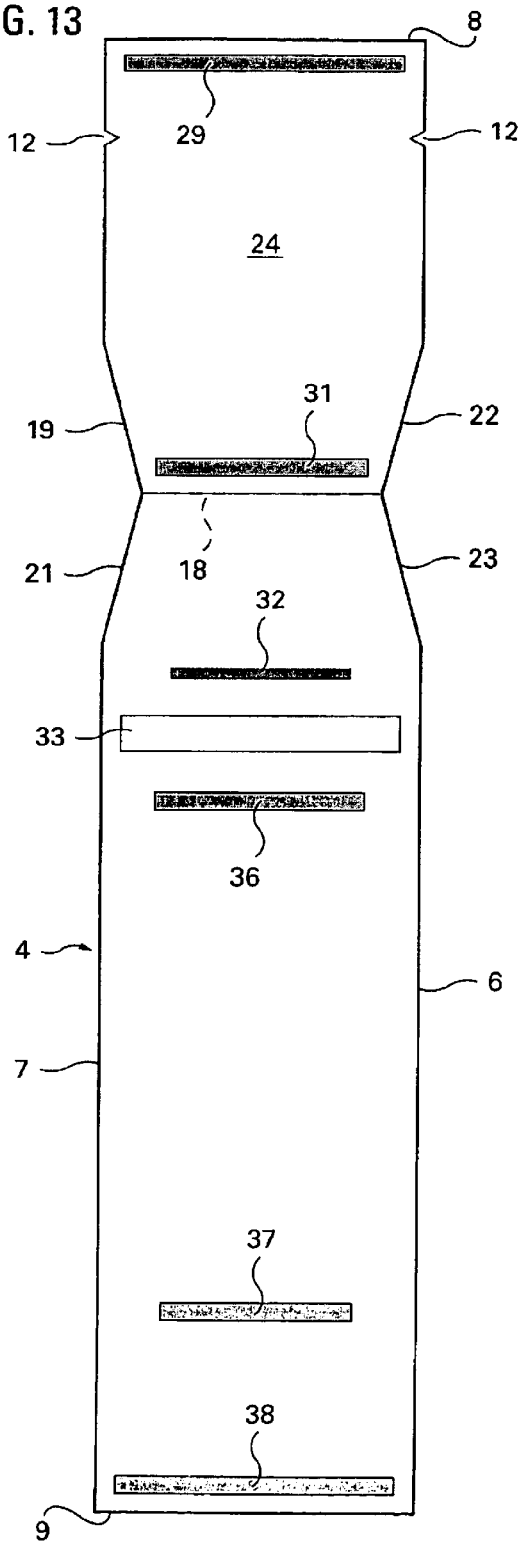
FIG. 13 is a plan view of the front or "right" side of the strip illustrated in FIG. 9 after the strip has been shaped as in FIG. 12 to form a pattern and turned over to expose the "right" or front side of the strip and attachments applied thereto.
Figure 15:
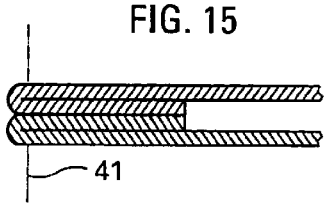
FIG. 15 is a fragmentary cross-sectional view taken in the plane of the line 15—15 in FIG. 4.

Specifically, and referring now to the drawings, it will be seen from FIG. 1 that the deployable and contractible cushion structure is designated generally by the numeral 2 in its finished form and in this view is shown in contracted form apart from the user. The finished deployable and contractible cushion structure is fabricated from a single sheet or layer of fabric material approximately 81½" long and 17¼" wide as illustrated in FIGS. 9 and 13 and designated generally by the numerals 3 and 4, respectively. The fabric is conveniently park cloth formed from 400 Denier "Nylon" back-coated with urethane to render the fabric water repellent and mildew and rot resistant. It should be noted that in FIG. 13 the elongated strip of fabric and is shown with its "right" or "front" side up, i.e., visible to the eye. The opposite side of this elongated strip of fabric material as seen in FIG. 9, being designated the "back" or "wrong" side of the elongated strip of material, i.e., not visible to the eye in FIG. 13 but shown visible to the eye in FIG. 9, where the elongated strip of fabric material 3 is shown with its "back" or "wrong" side up prior to application of any measures to specifically configure the elongated strip of fabric material, but marked with the word "TOP" adjacent its upper end as seen in FIG. 9. The elongated strip of flexible fabric material is provided with elongated lateral edges 6 and 7, a top edge 8 and a bottom edge 9 as shown in FIGS. 9 and 13. Approximately 10½" from the top edge 8 along each of the side or lateral edges 6 and 7 small notches 12 are made to serve as indicators for subsequent placement of a seam as will hereinafter be described.

Additionally, measured from the top edge 8 approximately 17" along opposite lateral edges 6 and 7, and spaced inwardly two inches, two "dots" 13 and 14 are marked on the "wrong" side of the fabric (FIG. 9). Measured 25½" down from the top edge of the fabric strip two opposed notches 16 and 17 are made in the lateral edges of the fabric strip to mark the location of a fold line 18 shown as a broken line in the interest of clarity.

Figure 10:
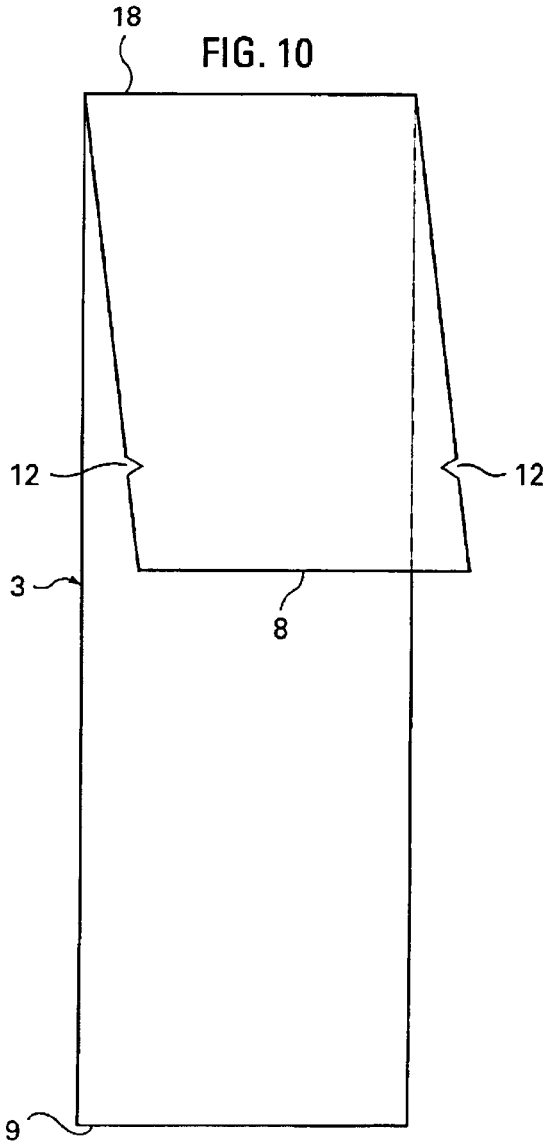
FIG. 10 is a perspective view illustrating the top portion of the strip illustrated in FIG. 9 folded at the edge notches spaced farthest from the top edge so that the top portion overlaps the underlying cloth strip. A portion of the strip is omitted to reduce the size of the view.
Figure 11:
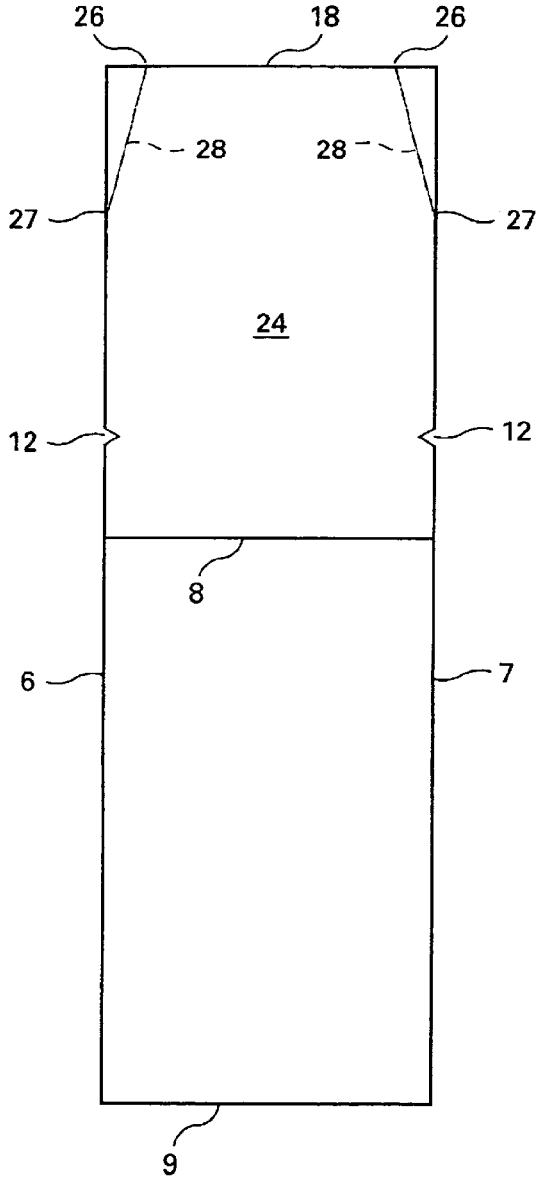
FIG. 11 is a plan view of the folded cloth strip illustrated in FIG. 10 with the fold line ironed to flatten the overlapped top portion onto the underlying strip portion and the upper opposed corner portions marked for cutting. A portion of the strip is omitted to reduce the size of the view.

Referring to FIG. 13, intermediate the top and bottom edges 8 and 9, respectively, the elongated edges 6 and 7, at a point spaced about one third the length of the strip from the top edge 8, are provided with oppositely facing gores formed on the left edge 7 by diverging edge portions 19 and 21, and on the right edge 6 formed by diverging edges 22 and 23. These gores are formed by folding the top end portion 24 of the elongated strip 4 as seen in FIG. 9 along the fold line 18 which is approximately 25½" from the top edge 8 of the elongated strip as seen in FIGS. 9 and 13. After folding the strip portion 24 along the fold line 18 so as to overlap an equal portion of the remainder of the strip as seen in FIGS. 10 and 11, the strip is marked at the fold line 18 with two dots 26, each dot being spaced laterally inwardly two inches from the associated edges 6 and 7 as shown.

With the elongated strip folded in this manner, the dots 13 and 14 will be spaced approximately 8½" from the fold line 18. At this location (8½" from the fold line), with a ruler or other straight edge lightly mark the overlapped edges 6 and 7 coincident with the dots 13 and 14 and from these edge marks 27, with a ruler, mark cutting lines 28 connecting the edge marks 27 to the dots 26 marked on the fold line 2" in from each edge. With scissors or other appropriate cutting tool, cut through both layers of overlapped strip material along these cutting lines 28 and remove and discard the triangular segment of fabric that results from the cutting operation.

After this cutting operation which, incidentally may be accomplished on a stack of folded strips so as to form this cutting operation on multiple strips at one time and in one operation, each strip is unfolded (FIG. 13) and laid flat on its "back" or "wrong" side on a flat table with the "front" or "right" side facing upwardly as seen in FIG. 13. Working from the top edge 8, sew adjacent and parallel to the top edge 8 (FIG. 13) a 15" long strip of 1" wide "press to engage and peel to disengage" loop fastener material 29 such as that sold commercially under the trade name "VELCRO" or other equivalent loop or hook fastener material. The ends of the strip of fastener material should preferably be spaced about 1" from the associated edges 6 and 7 of the main strip 4 to accommodate seams as will be described hereinafter.

From the top edge 8, measure down to 1" above the fold line 18 and at this location sew onto the base strip 4 a strip 31 of "hook" fastener material approximately 10⅞" in length. The ends of the "hook" fastener strip 31 should be spaced about ¾" from the associated edges 19 and 22 that form the edge gore. Again referring to FIG. 13, from the top edge 8 measure down approximately 32" on each side edge 6 and 7 and mark a dot in the center of the rectangular strip and then mark a 9" zipper location coincident with the centered dot and perpendicular to the side edges 6 and 7 and at this location sew a zipper 32 to the underlying fabric.

From the top edge 8 (FIG. 13) measure down 35¼" and mark a transverse line across the width of the material to indicate the placement location for a waist strap pocket 33 (FIGS. 1–5, 7, 13, 18 and 20) adapted to slidably receive placement of a waist strap 34 therethrough. Appropriate fastening means such as buckle components or "press to engage and peel to disengage" fastener elements (not shown) are mounted on the end portions of the waist strap 34 to enable releasably attaching the structure snugly about the waist of a wearer. Preferably, the waist strap pocket 33 is formed from webbing material 2" wide and 14½" long. Along each end edge, a ½" portion is turned under and sewn to the overlying webbing material to provide a reinforced entrance to the strap pocket when the elongated opposed and parallel edges of the webbing material are sewn to the underlying base strip material with one long edge coincident with the transverse line marked on the strip material. It will thus be seen that the waist strap 34 may be threaded under the reinforced ends of the waist strap pocket so that it extends therethrough and emerges in free ends from opposite ends of the pocket 33.

Following placement and sewing of the waist strap pocket 33 on the base strip of material, a 42" measurement is made from the top edge 8 and there is sewn centered on the underlying strip material an 11¼" length of "loop" type fastener material 36 so that it extends transversely across the underlying strip with the ends of the "loop" fastener material spaced 3" from the side edges 6 and 7 as shown.

Starting from the bottom edge 9 of the flat laid out fabric strip 4 as seen in FIG. 13, measure up approximately 10¼" along each edge 6 and 7 and mark a transverse pencil line. Cut 10½" of "loop" type fastener material 37 and sew transversely centered on the underlying strip 4 at the location of the line. Then, adjacent the bottom edge 9 and parallel thereto, sew on a 1" wide and 15" long strip 38 of "hook" type fastener element material with the ends spaced 1⅛" from the side edges 6 and 7 as shown in FIG. 13. Having thus prepared the base strip 4 by placement and secure attachment of the various components described above, the elongated strip 4 is turned over so that the "front" or "right" side of the elongated strip 4 is face down on a flat tabletop and the "back" or "wrong" side of the elongated strip faces upward to enable commencement of the final formation of the cushion structure.

Figure 12:
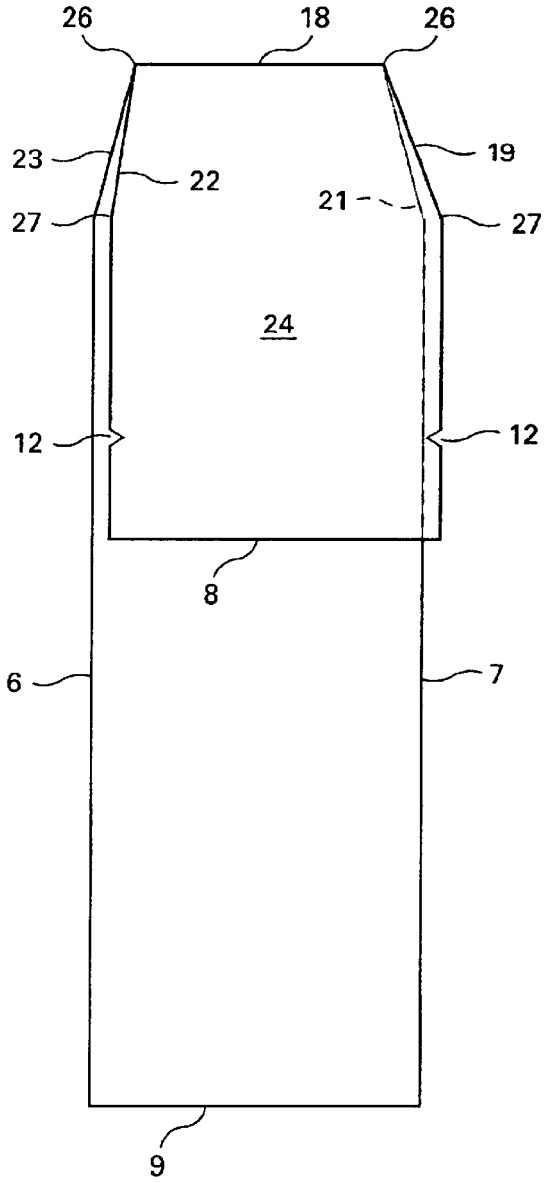
FIG. 12 is a perspective view similar to FIG. 10 but illustrating the overlapped top and underlying portions after the corner portions have been cut away.
Figure 14:
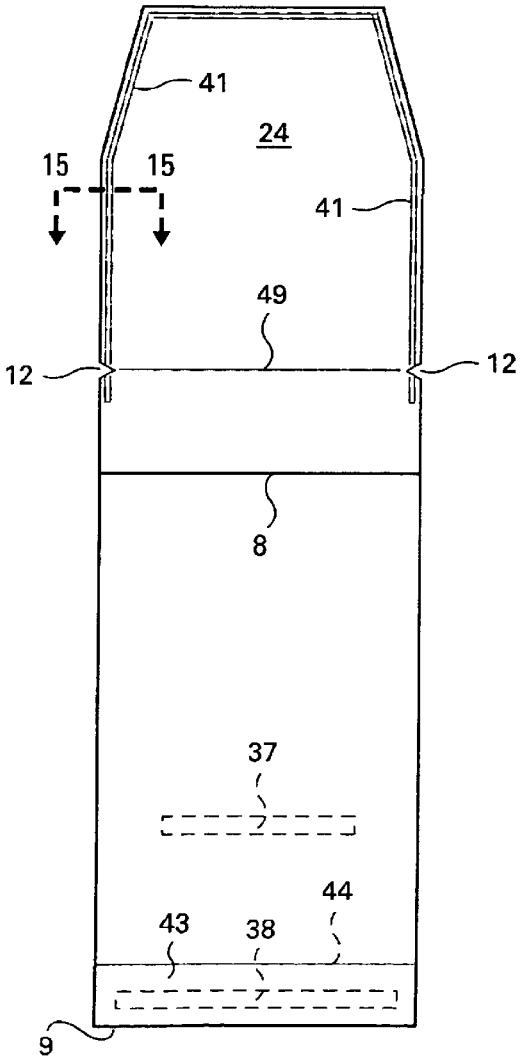
FIG. 14 is a fragmentary plan view after the patterned strip has been turned over and opened up with "wrong" or back side facing up as illustrated in FIG. 9 and the overlapped top portion has been ironed flat onto the underlying strip portion and the top and underlying portions have been edge stitched as illustrated by the broken lines.
Figure 16:
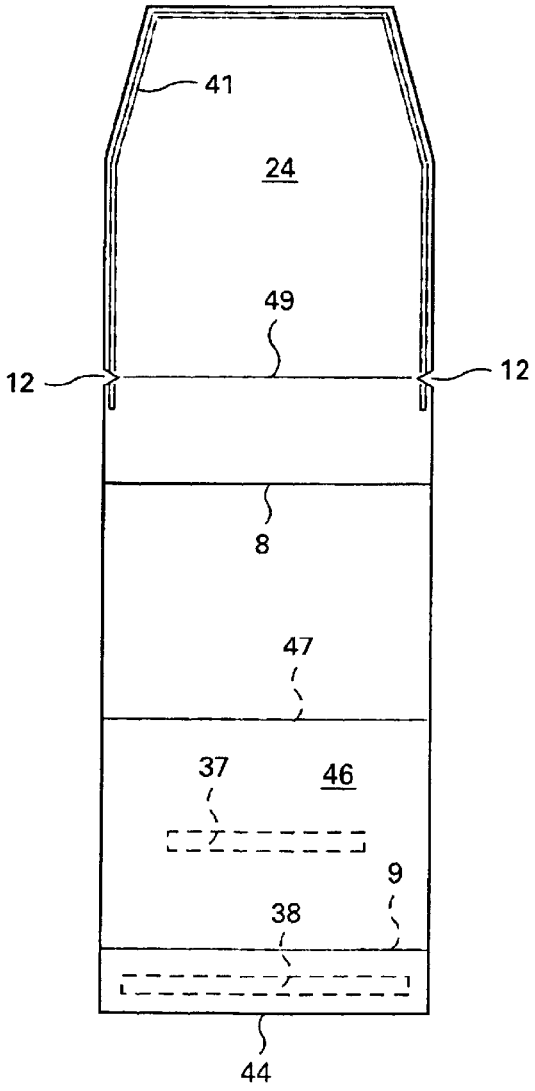
FIG. 16 is a plan view of the fabric strip with the "wrong" or back side facing up, with the upper flap portion folded down and stitched as in FIG. 14, and the bottom edge portion folded up a predetermined distance.
Figure 17:
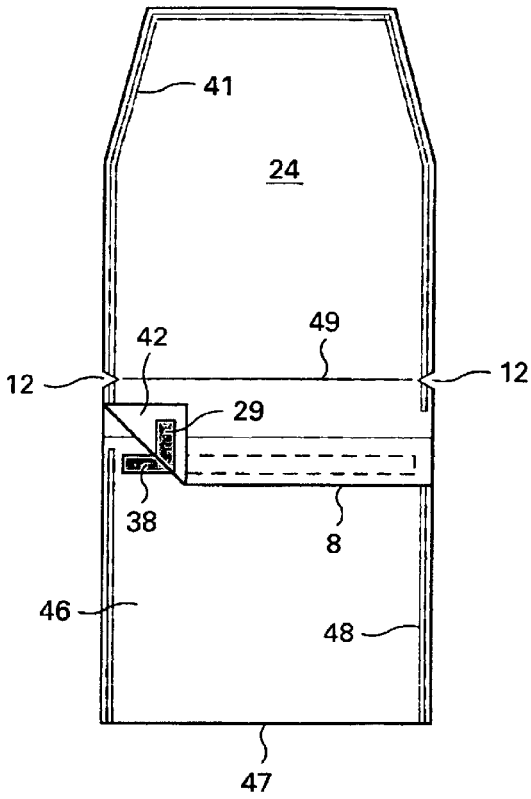
FIG. 17 is a plan view of the patterned elongated strip folded at the fold line shown in FIG. 16 so that the folded lower end portion of the strip is tucked under the overlapping end portion of the top portion of the strip.

The upper portion 24 of the strip is now grasped from its top edge 8 and folded over onto the main portion of the strip at the fold line 18 which, as seen in FIG. 13, coincides with the narrowed portion of the strip formed by the oppositely facing gores in the opposite edges 6 and 7. This relationship is shown in FIG. 12. Next, the bare overlapped edges of the material are folded under to provide a ½" seam allowance and the overlapped folded edges of the fabric are initially temporarily pinned together and then permanently secured together by stitching 41 as shown in FIGS. 14, 15, 16 and 17. This stitching should be effected close to the coincident folded edges of the fabric and should include backstitching to ensure a strong seam. Additionally, as seen in FIGS. 14, 16 and 17, the stitching 41 incorporates a ½" seam allowance and extends to within about 3" from the end edge 8 where it terminates to leave a 3" flap or "lip" 42 for a purpose which will hereinafter be explained.

Referring to FIG. 14, a 3" lower edge portion 43 of the base strip adjacent the lower edge 9 is folded back upon the "right" or "front" side along a fold line 44 so that the lower edge of the base strip now becomes the fold line 44 while the previously designated lower edge 9 is 3" above the fold line 44 as seen in FIG. 16. From the pressed fold line 44, measure up 15½" and fold the lower portion 46 (FIG. 16) upward along a fold line 47. The 3" portion 43 (FIG. 14) formed by the fold line 44, is now tucked temporarily under the 3" flap or "lip" 42 as seen in FIG. 17, a corner portion of which has been lifted to show the underlying structure. The overlapped raw edges of the material are folded under to provide a ½"

seam allowance, the overlapped edges are initially pinned and then sewn along the folded edges by stitching 48. Where the stitching 41 meets the stitching 48, the edges are backstitched to increase the strength of the union. The structure thus formed is then turned over so that the "right" side is facing upward and all edges are pressed crisp.

Figure 8:
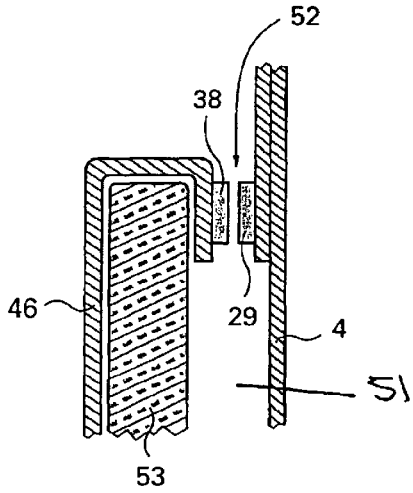
FIG. 8 is a fragmentary vertical cross-sectional view taken in the plane indicated by the line 8—8 in FIG. 7.
Figure 18:
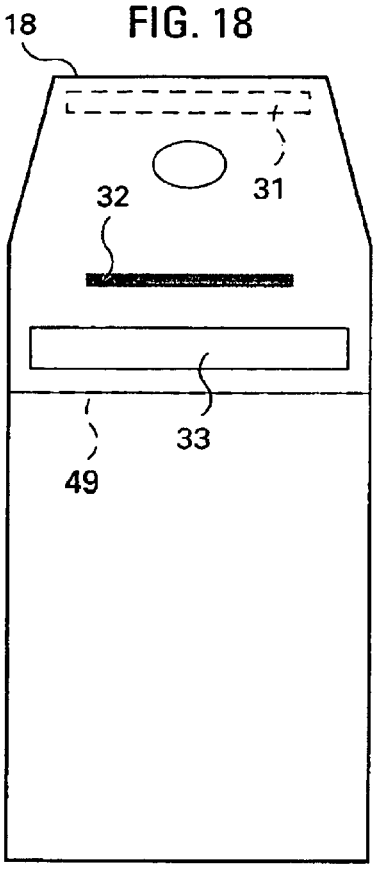
FIG. 18 is a plan view illustrating the elongated strip partially folded and indicating the location of a stitch line that ultimately becomes a fold line.

With the structure laid out as in FIG. 18, measure down 15⅛" where the notches 12 are located and place a row of stitching 49 transversely there-across to thus sew the upper portion 24 down on the underlying main strip 4. It will thus be seen that a first pocket 51 having an entrance opening 52 thereinto is formed by the strip portion 46 that is folded upward and sewn to the underlying main strip portion by stitching 48. The entrance 52 into this main or first pocket is formed at the upper folded edge 44 that is tucked under the 3: flap or "lip" 42. This main or first pocket 51 encloses an elastically resilient relatively thick (1"+) cushion pad 52 (FIG. 8) conveniently formed of open or closed cell polyurethane or other suitable material.

Figure 19:
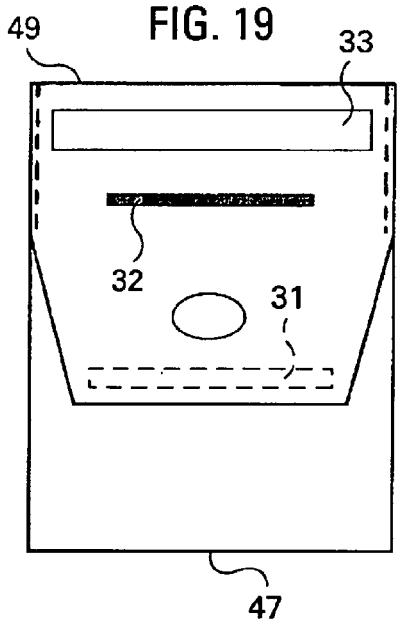
FIG. 19 is a plan view of the structure illustrated in FIG. 18, folded along the stitch line.
Figure 20:
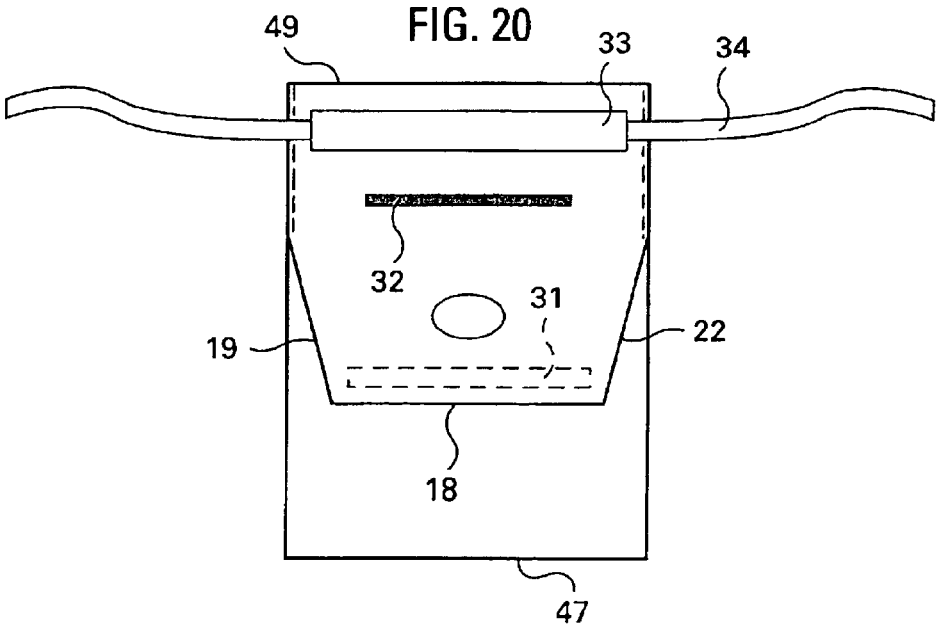
FIG. 20 is a plan view of the completed structure illustrating the waist strap band and a waist strap threaded through the waist strap band and illustrating the structure extended but with the pad of elastically resilient material enclosed in the first pocket, a portion of which has been cut away to illustrate the enclosed elastically resilient pad.

To complete the assembly, the upper portion 24, now sewn to the underlying strip portion, is folded back over the lower portion of the strip that is tucked under the 3" flap or lip 42. This fold is made at the fold line 49 (FIG. 17) and results in the arrangement shown in FIG. 19 where it is seen that the strip fastener 31 releasably engages the confronting strip fastener 37. This positions the waist strap pocket 33 adjacent the fold line 49 (FIGS. 19 and 20) and enables insertion of the waist belt or strap 34 to be threaded therethrough. As previously described, the zipper 32 is placed in an opening in the "flap" portion of the main strip that folds along the fold line 18 and forms the entrance to a third pocket contained between the two adjacent and superposed main strip portions that are sewn along their peripheral edges.

Figure 3:
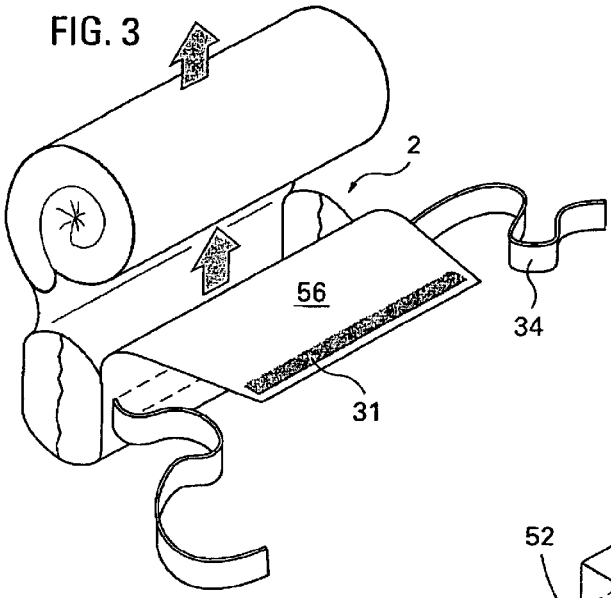
FIG. 3 is a perspective view of the cushion structure partially deployed by withdrawal of the first pocket containing the elastically resilient cushion pad from the second pocket in which it is normally removably contained and shown partially unrolled.
Figure 4:
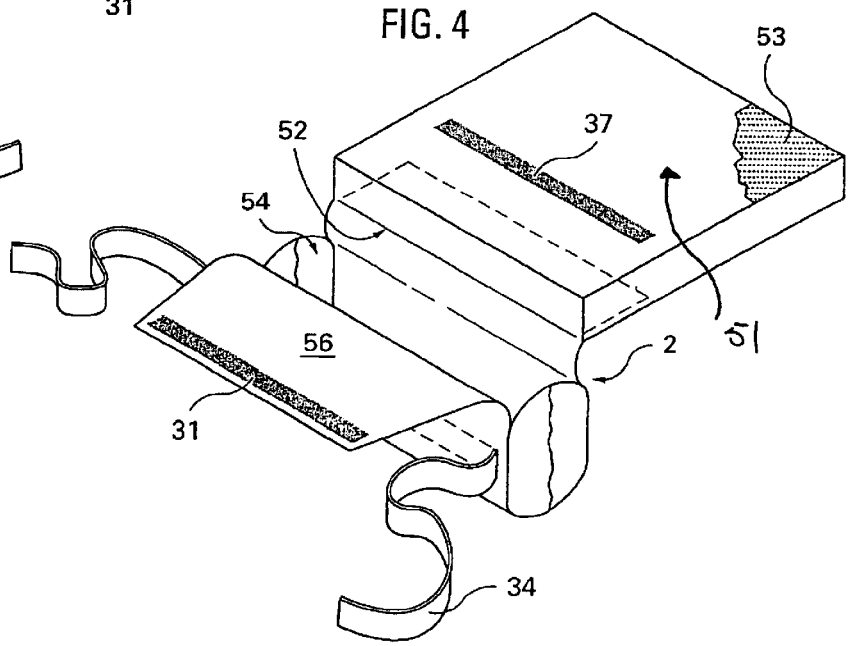
FIG. 4 is a perspective view illustrating the cushion structure completely unrolled and ready to be deployed for use on a bench or chair.
Figure 5:
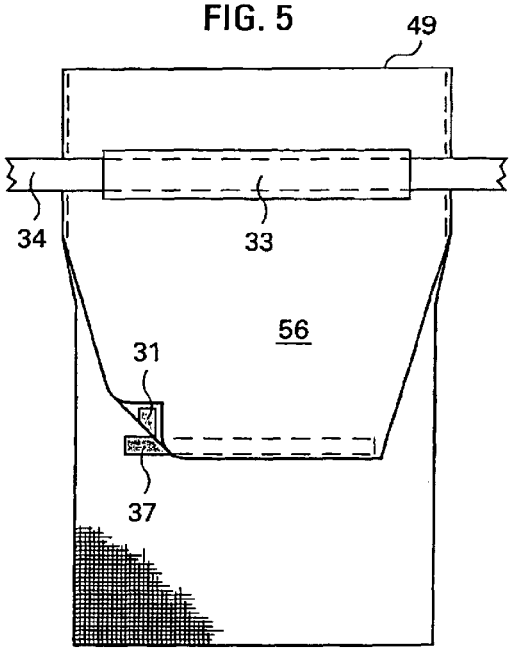
FIG. 5 is a top plan view of the top side of the cushion structure illustrating the fabric of the first pocket containing the cushion pad extended into a generally quadrilateral form for use, with the fabric forming the second pocket extended in substantially the same plane as the fabric of the first pocket and with the flap that closes the second pocket and which contains the third pocket overlapped, extended and releasably secured to an underlying fastener element fixed on the underlying fabric of the first pocket. A corner of the flap is folded back to illustrate the cooperating fasteners.
Figure 6:
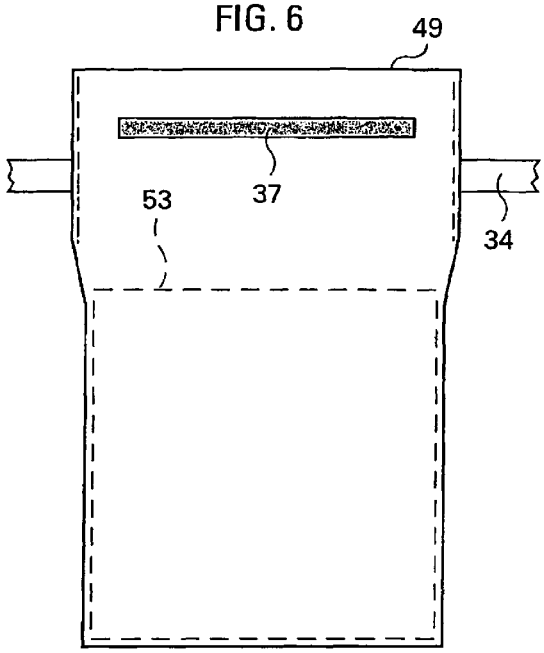
FIG. 6 is a bottom plan view of the extended cushion structure illustrated in FIG. 5 and illustrating one of the fastener elements fixed to the back side of the fabric of the second pocket which cooperates with a complementary fastener element secured to the edge portion of the flap and which together, when engaged, retain the cushion structure in a contracted form as shown in FIG. 1.
Figure 7:
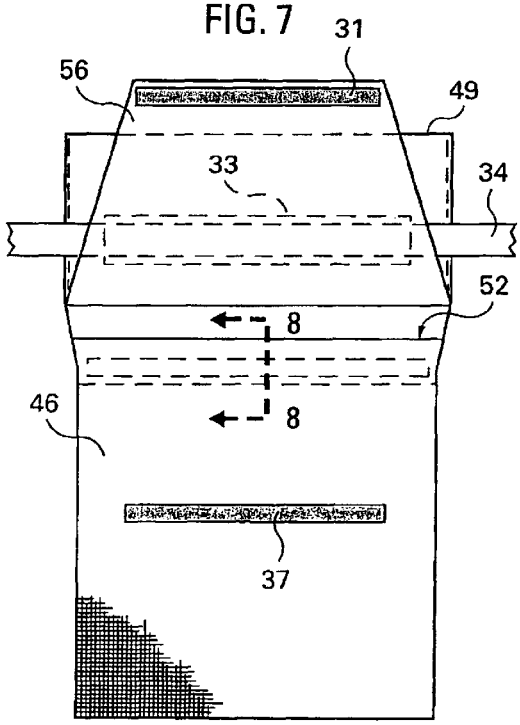
FIG. 7 is a top plan view similar to FIG. 5 but illustrating the closure flap for the second pocket folded back to reveal the entrance into the second pocket and the confronting entrance into the first pocket.

It will thus be seen that the pad of elastically resilient cushion pad material may be inserted into the first pocket and lies contained therein as illustrated in FIG. 4. In this condition, i.e., with the elastically resilient cushion pad extended or deployed to its preferred condition for use, a person may sit on the cushion pad comfortably for long intervals without the hardness of the underlying seat structure penetrating through the cushion pad. When it is desired to contract the structure for attachment about the waist of a user, the elastically resilient cushion pad and first pocket are rolled as one as seen in FIG. 3 until the rolled cushion pad can be introduced into or inserted into the associate and confronting entrance of the second pocket 54.

Having thus described the invention, what is believed to be new and novel and sought to be protected under the patent laws of the United States is as follows.

I claim:

1. A deployable and contractible cushion structure adapted to be detachably secured about the waist of a wearer when in contracted form and to form a seat cushion when extended, comprising;

a) an elongated strip of flexible fabric folded and sewn to provide at least a first pocket and a second pocket, each of said first and said second pockets having an entrance opening thereinto wherein the opening of said first pocket confronts the opening of said second pocket;

b) a pad of elastically resilient cushioning material contained within said first pocket and forming a cushioned seat structure when extended and a generally cylindrical body when contracted; and c) a flap forming a portion of said elongated strip of fabric and manipulable to retain said pad of elastically resilient cushioning material in contracted form when detachably secured about the waist of a wearer, said flap further forming a closure for said second pocket when manipulated to retain said cushion structure in contracted condition.

2. The cushion structure according to claim 1, wherein said strip of flexible fabric is coated on at least one side with a compound rendering said fabric water repellent.

3. The cushion structure according to claim 1, wherein a third pocket having an entrance opening is formed in said flap forming a portion of said elongated strip.

4. The cushion structure according to claim 1, wherein means are provided on said elongated strip selectively to close the entrance opening of said first pocket to retain said pad of elastically resilient material contained within said first pocket or to selectively open said entrance of said first pocket to enable extraction of said pad of elastically resilient cushioning material.

5. The cushion structure according to claim 1, wherein means are provided on said strip of flexible fabric for selectively releasing and engaging fasteners on said strip of flexible fabric, said fasteners engaging to retain said cushion structure in contracted condition.

6. The cushion structure according to claim 1, wherein means are provided on said flexible fabric strip adjacent said flap and manipulable to selectively encircle and detachably secure the cushion structure about the waist of a wearer.

7. The cushion structure according to claim 2, wherein said elongated strip of fabric is formed of 400 Denier pack cloth formed from synthetic resinous material and back-coated with urethane to render the fabric water repellent.

8. The cushion structure according to claim 4, wherein said means for selectively opening or closing the entrance opening of said first pocket comprises complementary press-to-engage and peel-to-disengage fastener elements.

9. The cushion structure according to claim 5, wherein said means on said flap and on said strip for retaining said cushion structure in contracted condition comprise push-to-engage and peel-to-disengage fastener elements.

10. The cushion structure according to claim 7, wherein said pack cloth is woven from Nylon filamentary material.

11. A portable cushion device, comprising:

a single sheet of fabric formed to provide at least a first pocket and a second pocket;

a first opening for selectively accessing said first pocket;

a second opening for selectively accessing said second pocket;

a pad, said pad selectively inserted into, and withdrawn from, said first pocket through said first opening;

a plurality of fastener mechanisms selectively operated to open and close said first and said second openings; and wherein said pad is inserted into said first pocket to form a seat cushion in an extended state.

12. The portable cushion device of claim 11, wherein said pad and said first pocket are contracted in order to be inserted into, and secured within, said second pocket.

13. The portable cushion device of claim 12, wherein said portable cushion device forms a generally cylindrical body.

14. The portable cushion device of claim 12, further comprising a waist strap, said strap securing said portable cushion device to the body of a user.

15. The portable cushion device of claim 11, wherein at least one of said plurality of fastener mechanisms is used to secure said pad within said first pocket.

16. The portable cushion device of claim 11, wherein at least one of said plurality of fastener mechanisms is used to secure said pad and said first pocket within said second pocket.

17. The portable cushion device of claim 11, wherein said single sheet is formed to provide a third pocket.

18. A portable cushion device, comprising:

a length of fabric formed to provide at least a first pocket and a second pocket;

a first opening for selectively accessing said first pocket;

a second opening for selectively accessing said second pocket, said first opening and said second opening located adjacently on said length of fabric;

a pad, said pad selectively inserted into, and withdrawn from, said first pocket through said first opening;

said pad is inserted into said first pocket to form a seat cushion in an extended state;

said pad and said first pocket being contractible for selectively inserting and withdrawing said pad and said first pocket into and from said second pocket;

a fastener selectively engaged to close said first opening and retain said pad in said first pocket; and a flap formed on said length of fabric, said flap closing said second opening, said flap having a closure mechanism to retain said pad and said first pocket when said pad and said first pocket are inserted into said second pocket.

* * * * *